US006543627B1

(12) United States Patent
Schiavo

(10) Patent No.: US 6,543,627 B1
(45) Date of Patent: Apr. 8, 2003

(54) SHELF CONSTRUCTION

(76) Inventor: Dana Schiavo, 530 E. 84th St., New York, NY (US) 10028

( * ) Notice: Subject to any disclaimer, the term of this patent is extended or adjusted under 35 U.S.C. 154(b) by 0 days.

(21) Appl. No.: 10/032,747

(22) Filed: Dec. 28, 2001

(51) Int. Cl.[7] ..... A47F 7/00
(52) U.S. Cl. ..... 211/26; 211/94.01
(58) Field of Search ..... 211/26, 94.01, 211/162, 1.51, 13.1, 88.01, 87.01, 90.02, 90.01; D6/553, 567, 574

(56) References Cited

U.S. PATENT DOCUMENTS 2,009,965 A * 7/1935 Pollock
3,895,605 A * 7/1975 Goldman
4,209,098 A * 6/1980 Adams ..... 211/94.01 X
4,453,714 A * 6/1984 Houser
4,899,971 A * 2/1990 Elkin ..... 211/94.01 X
5,341,942 A * 8/1994 James ..... 211/40
5,472,167 A * 12/1995 Shillington et al. ... 211/94.01 X
5,711,435 A * 1/1998 Morison et al. ..... 211/94.01 X
5,794,795 A * 8/1998 Stemmons ..... 211/26
6,092,676 A * 7/2000 Graham ..... 211/94.01
6,142,315 A * 11/2000 Arout ..... 211/45
D436,782 S * 1/2001 Rapp

* cited by examiner

*Primary Examiner*—Robert W. Gibson, Jr.
(74) *Attorney, Agent, or Firm*—Schweitzer Cornman Gross & Bondell LLP

(57) ABSTRACT

A shelf construction includes a shelf unit adapted for mounting on a vertical surface. The shelf unit has a transverse slot extending along the length of the slot. Devices having a base dimensioned for removable mounting in the slot are also provided. One or more of the devices may be an electrical device, in which case the base includes electrical contacts which align with electrical contacts provided in the slot. The slot electrical contacts are connected to an appropriate power source, such as a line-operated transformer or power pack.

10 Claims, 4 Drawing Sheets

FIG. 3A
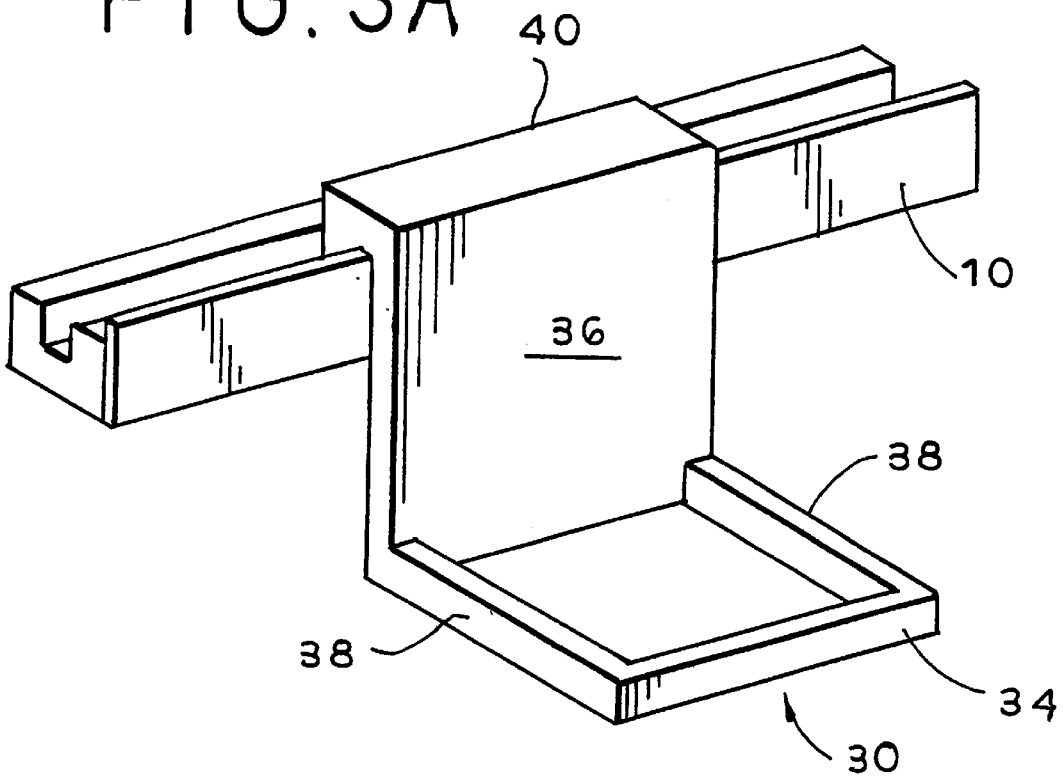
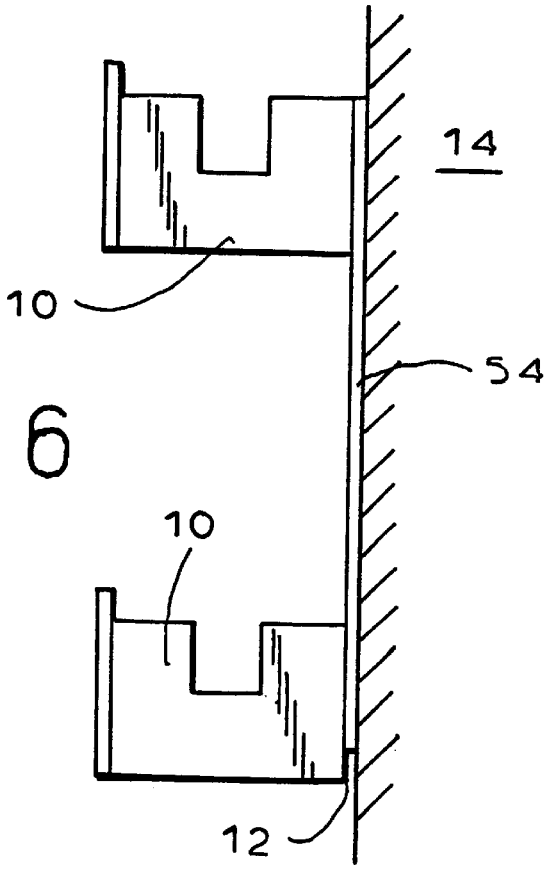
FIG. 6

SHELF CONSTRUCTION

The present invention relates to a new and improved shelf construction and particularly to a shelf construction especially well adapted for use in children's rooms and play areas.

BACKGROUND OF THE INVENTION

A child's play and living area, whether it be a bedroom, den, playroom or the like, should provide an attractive and supportive environment for the child. It is recognized that a room environment which provides age-appropriate activities and visual stimuli, particularly for a young child, can help foster mental and intellectual growth.

Towards this end, a wide range of "educational" toys and devices are in the market. Such products range, for the infant, from crib-supported mobiles and touch toys to, for the older child, alphabet games, dolls, movable toys and games and activities of many different types.

The veritable plethora of such toys and games brings with the, a difficulty of display and storage. A toy which is not easily accessible and visible to a child is often a toy which is not utilized. At the same time, there is a need for storage and display space in the child's environment which is both practical, convenient and aesthetically pleasing to the child.

The present invention is directed to both concerns, and provides both an entertainment medium for a child as well as a storage means. The present invention comprises a shelf construction mountable to a wall which may serve as an integral part of a toy system as well as a storage system. In particular, a shelf element is provided with integral means upon which a plurality of toy elements may be placed. The toy elements may comprise letters, numbers or figures, as well as more complicated toy elements, such as toy trucks or trains, as well as other child-related household goods, such as a radio or lamp. Means may be provided in the shelf element to power the toys and other devices which require electrical energy.

In addition to serving as a base or receptacle for such toy and other play devices, the shelf may itself serve as a base for the mounting of other display elements. Further shelf elements, as well as, box, tray units, and the like may be mounted to the shelf, expanding its utility and allowing a wide variety of objects to be stored, displayed or other positioned thereon. Both storage and toy elements may be combined or intermixed upon the shelf, providing broad flexibility of use for the shelf construction of the invention.

BRIEF DESCRIPTION OF THE DRAWINGS

A fuller understanding of the present invention and the features and benefits thereof will be achieved upon consideration of the following detailed description of preferred, but nonetheless illustrative embodiments thereof, when reviewed in conjunction with the annexed drawings, wherein:

FIGS. 3 and 3*a* illustrate a bin-like unit mounted on the shelf construction;

FIG. 6 is a side view of a tiered arrangement of shelves.

DETAILED DESCRIPTION OF THE INVENTION

Figure 1:
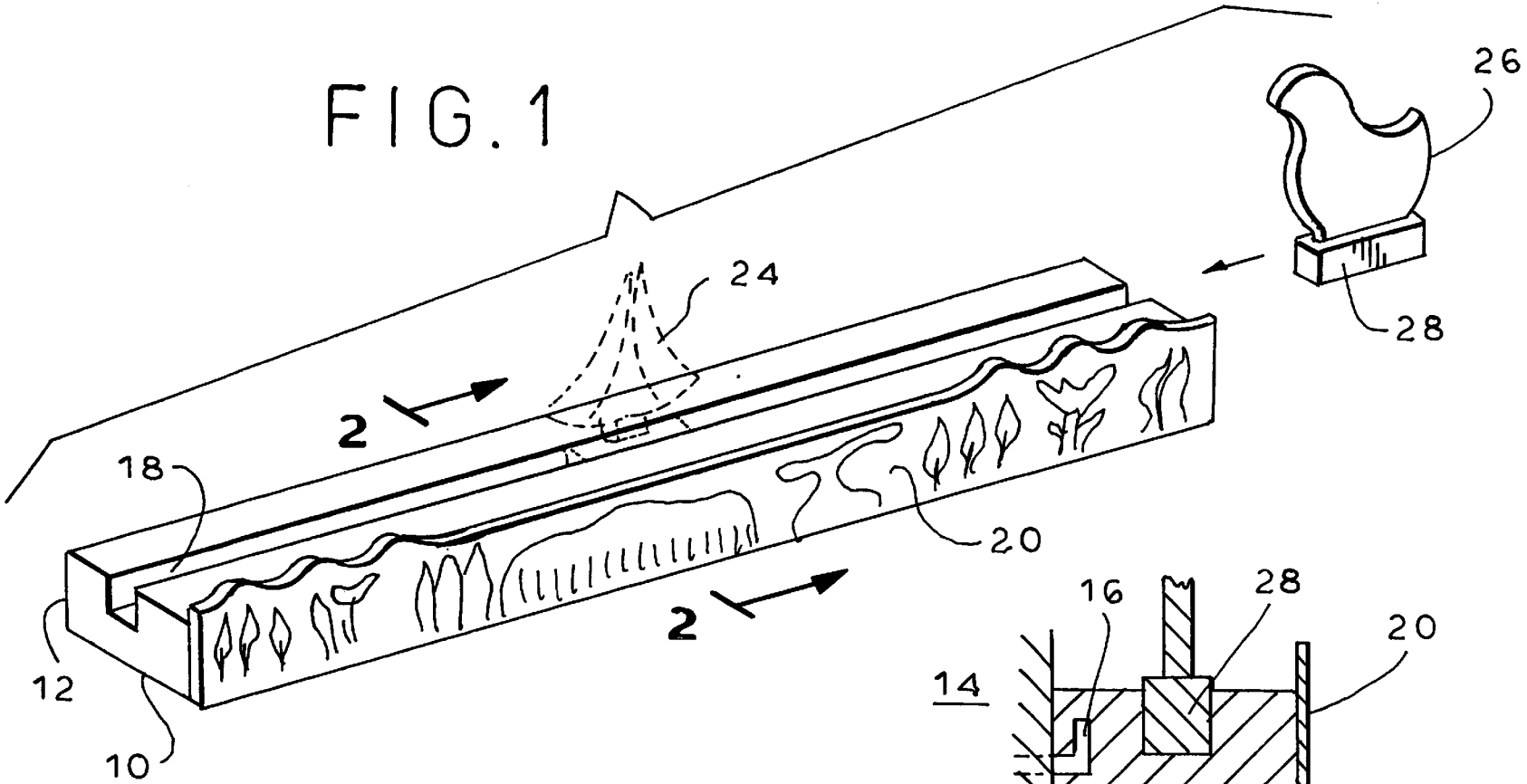
FIG. 1 is a perspective view of a portion of the shelf construction illustrating the mounting of representative toy figures thereon.

With reference to the Figures, the present invention comprises a relatively narrow shelf unit 10 having a rear wall 12 adapted to rest against a vertical surface, such as wall 14. The shelf unit 10 is preferably relatively narrow, on the order of one to two inches wide, and elongated construction, and may be formed of wood, composite, plastic or the like, chosen as appropriate to provide both rigidity and relatively light weight. Individual shelf units 10 may be of various lengths, on the order of anywhere from 1 to 4 feet or more. The shelf units may be utilized individually, or placed in an aligned, end-to-end relationship to produce a unitary shelf element construction of extended length. An end of a shelf element may be mitered to allow the shelf element to abut a similarly-mitered element to traverse a corner or otherwise angled abutting wall surfaces. The individual shelf units are provided with appropriate mounting means on the rear surface, such as slots 16, dimensioned and adapted to accommodate wall brackets in a manner known in the art.

A transverse slot 18 is milled in the top surface of the shelf unit 10 and preferably extends the full length thereof. When adjacent shelf units 10 are positioned on the wall, the slots 18 align to provide a continuous aperture extending the length of the shelf system. The slots are dimensioned to accept mounts for a variety of objects and structures, supporting the objects and structures on the shelf. A front facade panel 20 is mounted to the front face of the shelf and may extend upwardly above the top surface of the shelf, to provide both a measure of concealment for the slot, as well as a decorative appearance. The top edge 22 of the panel may be contoured as appropriate.

Figure 2:
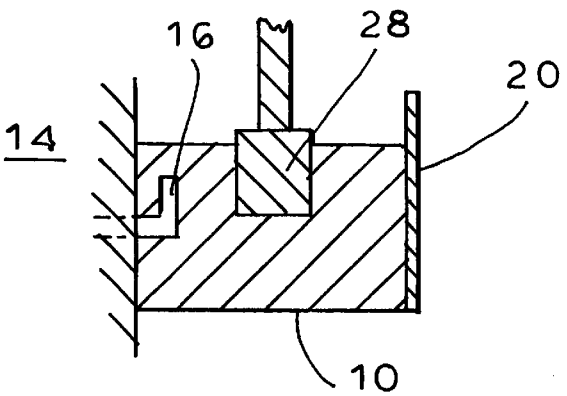
FIG. 2 is a section view taken along line 2—2 of FIG. 1.

As shown in FIGS. 1 and 2, figures, such as tree 24 or bird 26, may be formed of thin material, such as wood or plastic, and painted or otherwise adorned as appropriate, and mounted to a support block 28. The height of the block 28 is preferably chosen to be generally flush with the top surface of the shelf unit 10, such that it lies below the top edge of the facade 20. In addition to figures, individual letters or numbers, as well as combinations thereof, may be mounted on the blocks. The blocks and attached design objects can be easily inserted into, slid along, and removed from, the slot, providing both play interest and a decorative capability to the shelf.

Figure 3:
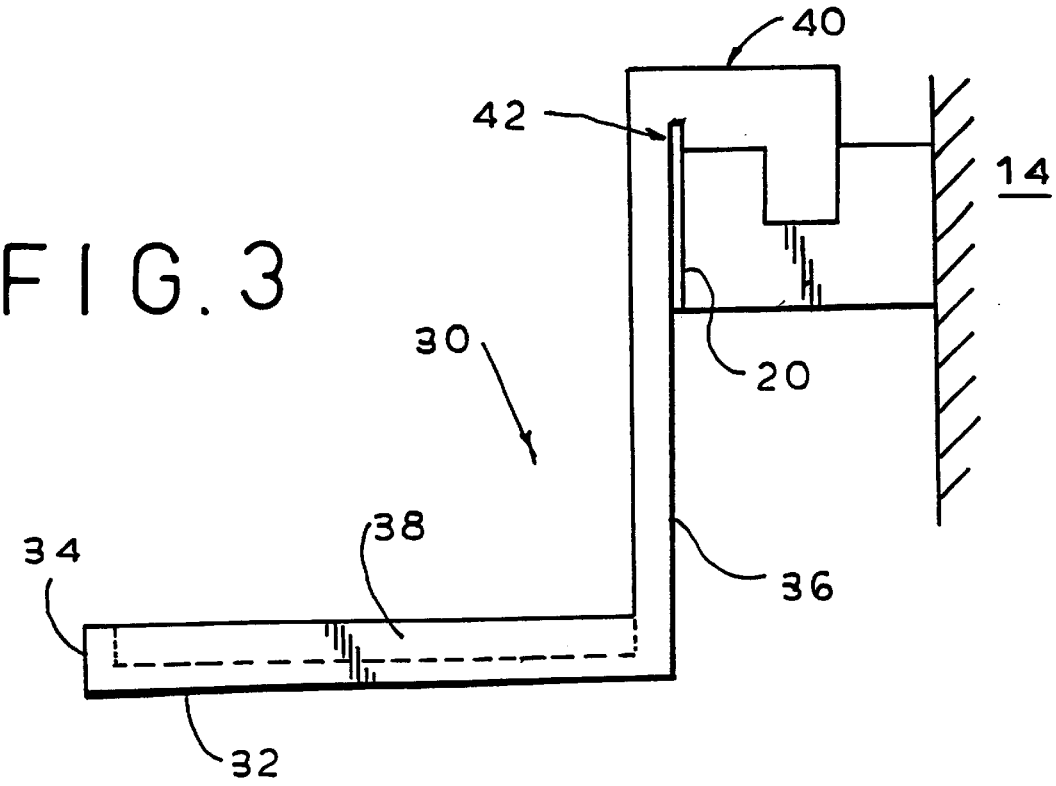
Figure 5:
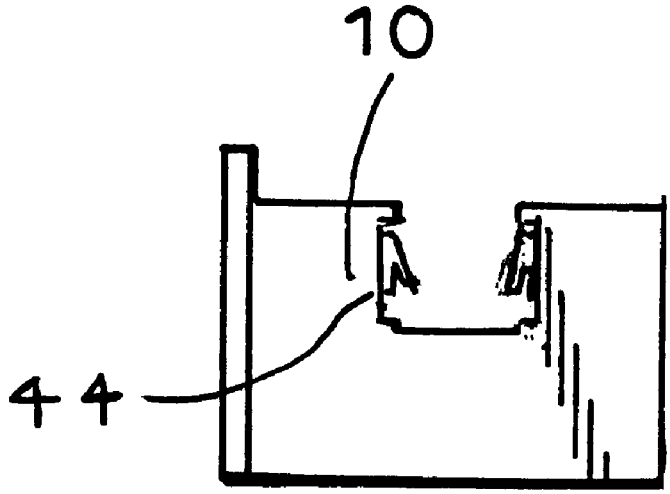
FIG. 5 is a perspective view of the bin-like unit of FIG. 3.

As depicted in FIGS. 3 and 5, the shelf unit 10 may also serve as a mount for auxiliary shelves and storage members, such as bin 30. The bin may include a floor 32 bounded by front and rear walls 34, 36 and sidewalls 38. The rear wall 36 extends upwardly and is capped with a rearwardly-directed, L-shaped bracket member 40 which bridges the front portion of the shelf unit 10 and extends into and mates with the slot 18. A small aperture 42 may be formed along the length of the inner portion of the L-shaped member to accommodate the upwardly-extending front facade 20. Once again, the bin and other similar storage units may be formed of any appropriate material, such as plastic, which provides the appropriate rigidity without excessive weight.

As may be appreciated, the bins, shelves and other storage units may be arrayed as desired along the length of the overall shelf construction, either by themselves or integrated with other display elements. As shown in FIG. 6, two or more shelf units 10 may be joined together by coupling bracket 54 affixed to their rear walls to provide a tiered construction. The coupling brackets may be removable.

Figure 4:
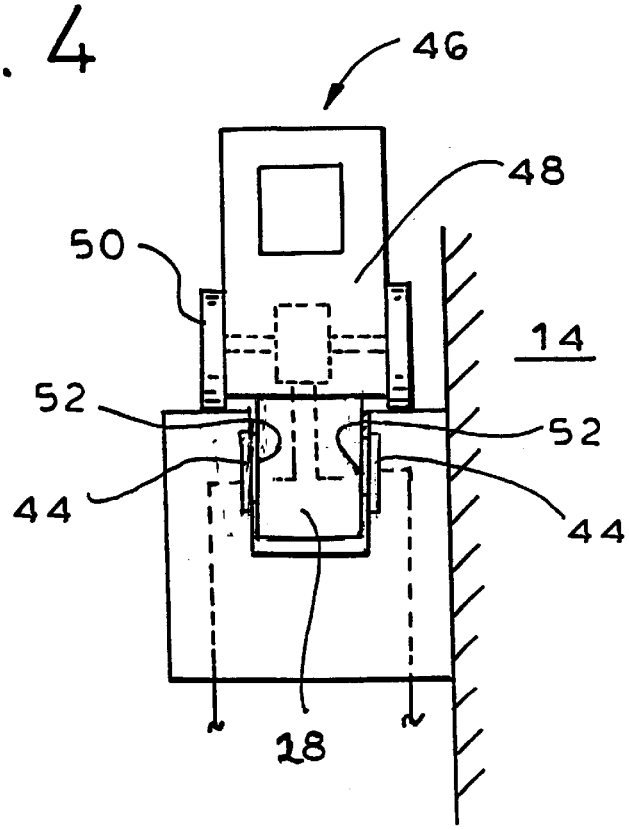
FIG. 4 is an end view depicting a shelf portion with an electrical device mounted thereon.

The innovative shelf construction of the present invention may also be used in conjunction with electrically-operated toys and other elements. As shown in FIG. 4, the sidewalls of the slots 18 may be provided with a pair of electrical contact elements 44. The contacts are mounted in opposed accepting grooves with a spring construction urging a portion of the contacts into contact with the sidewalls of the slots. In such a manner they do not affect the insertion of mountable elements, such as the blocks 28, in the slot. The contacts are supplied with an appropriate source of electrical power, such as generated by an appropriate line-powered step-down transformer (not shown). The ends of a shelf element may be provided with appropriate interconnects for the contacts to establish continuity of the respective contacts along extended lengths of adjacent shelf units. As an alternative to flush mounting, the contacts 44 may protrude slightly into the slots, as shown in FIG. 5, to assist in retaining the mountable elements, such as the blocks 18, in the slots, while still allowing movement and removal as desired. As the blocks 18 are of an electrically insulating material, the contact with the electrical contacts is of no concern.

By providing electrical power to the slots, a variety of electrical devices are installable upon the shelf elements. As shown in FIG. 4, an electric-powered toy train 46 is illustrative. The train car 46 is provided with a drive unit 48 to drive the wheels 50, which rest on the top surface of the shelf. The train car also has a downward-extending mounting block 28 which fits in the slot 18 and guides the train car. Mating contacts 52 are located on the opposed sides of the block to engage the contact elements 44 to deliver power to the electrical motor. The drive unit may include a motor and gearbox, and may optimally include a battery power pack which is changed when the train car is placed on the shelf. Such a construction can allow the toy to be used both on the shelf and in other locations.

Other electrically-powered devices can be similarly mounted on the shelf. For example, a radio construction may be provided with a mounting block 28 having the necessary contacts to allow electrical power to be provided to the radio. In a like manner, a lamp may be provided. Other electrically-powered toys and devices may similarly be mounted upon, and draw electrical power from, the shelf. The devices may be positioned as desired along the shelf, either individually or in combination with other mountable elements, thus providing extreme flexibility, coupled with enhanced shelf utility.

I claim:

1. A shelf construction, comprising at least one shelf unit having a rear wall adapted for mounting upon a vertical surface, a top surface having a transverse slot extending therealong, and a front surface; a facade element mounted to the front surface of the shelf unit and extending upwardly above the top surface of the shelf unit; and at least one device having a base dimensioned for removable mounting in the slot.

2. The shelf construction of claim 1, wherein the device is a storage unit having a rear wall, the rear wall comprising a bracket adapted for removable mounting in the slot.

3. The shelf construction of claim 1, wherein the device is chosen from the group consisting of toy figures, numbers and letters.

4. The shelf construction of claim 1 comprising upper and lower shelf units joined together by brackets affixed to the units' rear walls.

5. A shelf construction, comprising at least one shelf unit having a rear wall adapted for mounting upon a vertical surface, a top surface having a transverse slot extending therealong and having a pair of electrical contacts therein, and at least one device having a base dimensioned for removable mounting in the slot.

6. The shelf construction of claim 5 further comprising a facade element mounted to a front surface of the shelf unit and extending upwardly above the top surface of the shelf unit.

7. The shelf construction of claim 5 or 6, wherein the electrical contacts are located on opposed slot sidewalls and extend the length of the slot.

8. The shelf construction of claim 5 or 6 wherein the device comprises an electrically-powered device.

9. The shelf construction of claim 8 wherein the electrically-powered device includes a pair of electrical contacts for providing electrical power to the device located on the base to engage with the electrical contacts within the slot.

10. The shelf construction of claim 9 wherein the electrically-powered device is an electrically-motorized device.

* * * * *